US010364676B2

(12) United States Patent
Knuth

(10) Patent No.: US 10,364,676 B2
(45) Date of Patent: Jul. 30, 2019

(54) SYSTEMS AND METHODS FOR MONITORING LONGWALL MINE ROOF STABILITY

(71) Applicant: Joy MM Delaware, Inc., Wilmington, DE (US)

(72) Inventor: Jason Knuth, Brookfield, WI (US)

(73) Assignee: Joy Global Underground Mining LLC, Warrendale, PA (US)

( * ) Notice: Subject to any disclaimer, the term of this patent is extended or adjusted under 35 U.S.C. 154(b) by 256 days.

(21) Appl. No.: 15/182,816

(22) Filed: Jun. 15, 2016

(65) Prior Publication Data

US 2016/0362980 A1 Dec. 15, 2016

Related U.S. Application Data

(60) Provisional application No. 62/175,691, filed on Jun. 15, 2015.

(51) Int. Cl.

| | |
|---|---|
| ***E21F 17/18*** | (2006.01) |
| ***E21D 23/26*** | (2006.01) |
| ***E21C 35/12*** | (2006.01) |

(52) U.S. Cl.

CPC ..... *E21D 23/26* (2013.01); *E21C 35/12* (2013.01); *E21F 17/185* (2013.01)

(58) Field of Classification Search

CPC ..... E21F 17/18; E21F 17/185; E21C 35/12

See application file for complete search history.

(56) References Cited

U.S. PATENT DOCUMENTS

| | | | | |
|---|---|---|---|---|
| 3,672,174 | A * | 6/1972 | Von Hippel | E21D 23/0017 299/1.7 |
| 4,136,556 | A | 1/1979 | Graham | |
| 4,432,673 | A | 2/1984 | Buckmaster | |

(Continued)

FOREIGN PATENT DOCUMENTS

| | | | |
|---|---|---|---|
| EP | 2378059 | A1 | 10/2011 |
| GB | 2092207 | A * | 8/1982 |

OTHER PUBLICATIONS

International Preliminary Report on Patentability for Application No. PCT/US2016/037509 dated Dec. 28, 2017 (8 pages).

(Continued)

*Primary Examiner* — Sunil Singh

(74) *Attorney, Agent, or Firm* — Michael Best & Friedrich LLP

(57) ABSTRACT

Systems and methods are described for monitoring a condition of a mine roof using a longwall mining system. A plurality of powered roof supports is controlled to apply an adjustable support pressure on a mine roof. A condition of the mine roof is monitored based on the adjustable support pressure applied to the roof by a respective actuator of each powered roof support. In some implementations, the condition of the mine roof is monitored by generating and analyzing a graphical pressure map based on the adjustable support pressure applied by each powered roof support and a relative position of a shearer moving across the mine face. In some implementations, roof collapse events are detected based on temporally similar changes in the adjustable support pressure applied by multiple adjacent powered roof supports as indicated by the graphical pressure map.

23 Claims, 16 Drawing Sheets

(56) References Cited

U.S. PATENT DOCUMENTS

| | | | | |
|---|---|---|---|---|
| 4,518,285 | A | 5/1985 | Weber et al. | |
| 4,581,712 | A | 4/1986 | Perry et al. | |
| 4,887,935 | A | 12/1989 | Koppers et al. | |
| 5,029,943 | A | 7/1991 | Merriman | |
| 5,087,099 | A | 2/1992 | Stolarczyk | |
| 5,542,788 | A | 8/1996 | Stankus et al. | |
| 6,056,481 | A | 5/2000 | Watermann et al. | |
| 6,832,165 | B2 | 12/2004 | Stankus et al. | |
| 6,957,166 | B1 * | 10/2005 | Howie | E21F 17/185 702/138 |
| 7,308,139 | B2 | 12/2007 | Wentland et al. | |
| 2014/0077580 | A1 | 3/2014 | Holme | |

OTHER PUBLICATIONS

International Search Report and Written Opinion for Application No. PCT/US2016/037509 dated Aug. 24, 2016 (10 pages).
Search Report issued by the Polish Patent Office for Application No. P.425074 dated May 10, 2018 (7 pages with English Translation).
Hansen Safety and Power Product Specification for "Pressure Monitoring System EH-PressCater" www.elgorhansen.com (with English version).

* cited by examiner

SYSTEMS AND METHODS FOR MONITORING LONGWALL MINE ROOF STABILITY

RELATED APPLICATIONS

This application claims the benefit of U.S. Provisional Patent Application No. 62/175,691, filed Jun. 15, 2015, the entire contents of which are incorporated herein by reference.

BACKGROUND

Embodiments of the present invention relate to systems and methods for monitoring roof stability in underground longwall mining environments. As the shearer of a longwall mining system passes back and forth along the length of the machine, the powered roof supports (PRS) hold up the roof of the mine above the shearer. As the mining system advances into the coal seam, the mine roof fails and collapses behind the powered roof supports. However, until the mine roof collapses, the load placed on the PRS by the weight of the mine roof can lead to potentially dangerous conditions for both the mining equipment and for workers within the mine.

SUMMARY

Various embodiments of the invention provide methods and systems for monitoring roof stability in underground longwall mining environments. In one system, powered roof support pressure data and longwall shearer position data are received from the mining system and are plotted over time using colors to represent pressure generating a pressure map (e.g., a "heat map") that represents the amount of pressure that the roof is applying onto the entire system of PRS units. A color gradient is used to visualize the roof pressure variation across the longwall and a line, showing the position of the shearer on the mining system, is overlaid onto the pressure map. This plotting method allow mine operators to visualize when and where roof collapses have occurred and to alter their mining objectives and operations to match the observed mine roof conditions.

In one embodiment, the invention provides a longwall mining system including a plurality of powered roof supports and an electronic control unit. Each powered roof support includes a controllable hydraulic piston configured to apply an adjustable support pressure on a mine roof. The electronic control unit is configured to receive data from each powered roof support indicative of fluid pressure within each respective controllable hydraulic piston and to monitor a condition of the mine roof based on changes in the received data over a period of time.

In another embodiment, the invention provides a method of monitoring a condition of a mine roof using a longwall mining system. A plurality of powered roof supports arranged in series along a mine face are operated to apply an adjustable support pressure on the mine roof. A shearer is also operated to move across the mine face cutting into the mine face. Data is received from each powered roof support indicative of the adjustable support pressure applied by each individual powered roof support to the mine roof. A graphical pressure map is then generated based on the data received from each powered roof support. The graphical pressure map includes a plurality of parallel display lines each providing an indication of the adjustable support pressure applied to the mine roof by a different one of the powered roof supports over a period of time and a shearer position line indicative of a position of the shearer relative to the plurality of powered roof supports over the period of time overlaid onto the plurality of parallel display lines. A condition of the mine roof is monitored based on changes in the adjustable support pressure as shown in the graphical pressure map. In some embodiments, the condition of the mine roof is monitored by detecting temporally similar changes in the adjust support pressure applied to the roof by multiple adjacent powered roof supports indicative of a mine roof collapse event. In other embodiments, the operation of the longwall mining system is adjusted based on the monitored condition of the mine roof In yet another embodiment, the invention provides a control system for a longwall mining system. The control system includes a processor and a memory storing instructions that are executed by the processor to control the operation of the control system. The control system operates a plurality of powered roof supports arranged in series along a mine face to apply an adjustable support pressure on the mine roof. The control system also operates a shearer to move across the mine face cutting into the mine face. The control system receives data from each powered roof support indicative of the adjustable support pressure applied by each individual powered roof support to the mine roof and generates a graphical pressure map based on the received data. The graphical pressure map includes a plurality of parallel display lines each providing an indication of the adjustable support pressure applied to the mine roof by a different one of the powered roof supports of a period of time and a shearer position line indicative of a position of the shearer relative to the plurality of powered roof supports over the period of time overlaid onto the plurality of parallel display lines. The control system monitors a condition of the mine roof based on changes in the adjustable support pressure as shown in the graphical pressure map. In some embodiments, the control system monitors the condition of the mine roof by detecting temporally similar changes in the adjustable support pressure applied to the mine roof in multiple adjacent powered roof supports indicative of a mine roof collapse event. In other embodiments, the operation of the longwall mining system is adjusted by the control system based on the monitored condition of the mine roof.

Other aspects of the invention will become apparent by consideration of the detailed description and accompanying drawings.

DETAILED DESCRIPTION

Figure 1:
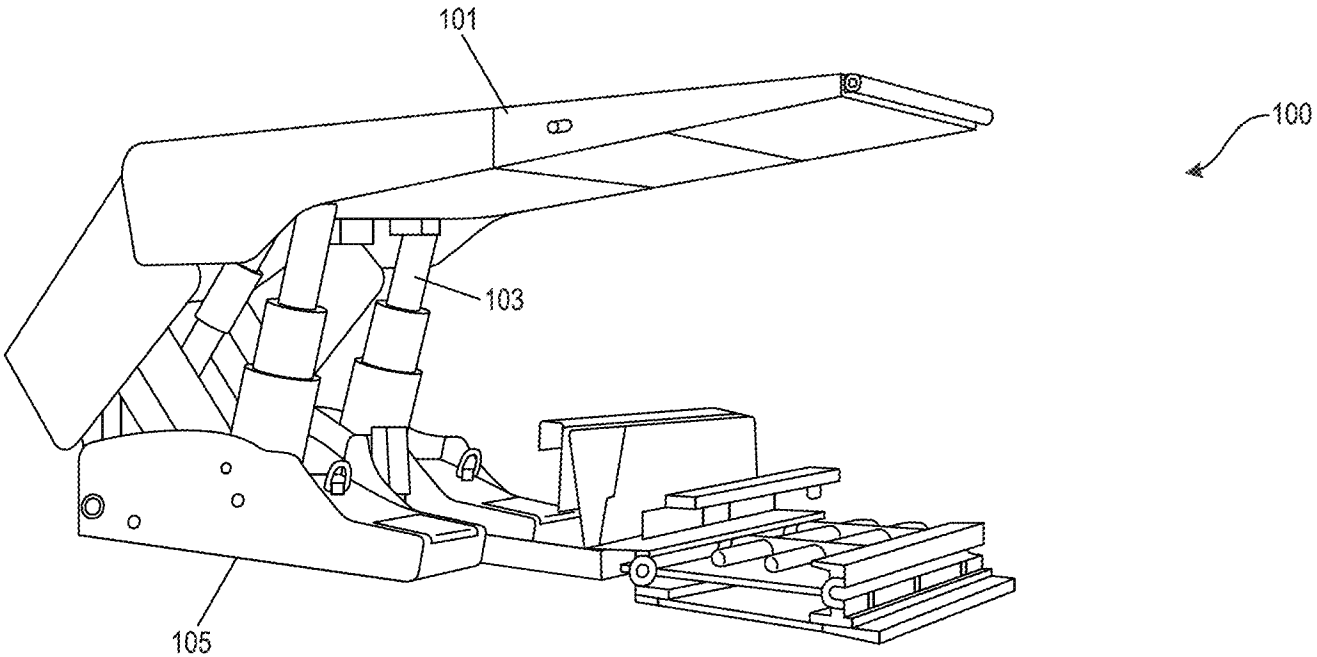
FIG. 1 is a perspective view of a powered roof support (PRS) according to one embodiment.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limited. The use of "including," "comprising" or "having" and variations thereof herein is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings, and can include electrical connections or couplings, whether direct or indirect. Also, electronic communications and notifications may be performed using any known means including direct connections, wireless connections, etc.

It should be noted that a plurality of hardware and software based devices, as well as a plurality of different structural components may be utilized to implement the invention. Furthermore, and as described in subsequent paragraphs, the specific configurations illustrated in the drawings are intended to exemplify embodiments of the invention and that other alternative configurations are possible. The terms "processor" "central processing unit" and "CPU" are interchangeable unless otherwise stated. Where the terms "processor" or "central processing unit" or "CPU" are used as identifying a unit performing specific functions, it should be understood that, unless otherwise stated, those functions can be carried out by a single processor, or multiple processors arranged in any form, including parallel processors, serial processors, tandem processors or cloud processing/cloud computing configurations.

FIG. 1 illustrates a powered roof support (PRS) 100 for longwall mining. PRSes, like PRS 100, are used to support the roof of a mine (such as, for example, a coal mine) above a shearer as the shearer passes across a face of the material being mined (as discussed in further detail below). The PRS 100 includes a load-bearing support canopy 101 and a pair of controllable hydraulic cylinders 103 positioned between the load-bearing canopy 101 and a base 105. The controllable operation of the hydraulic cylinders 103 raises and lowers the canopy 101 relative to the base 105 and provides pressure to maintain the position of the canopy 101 against the mine roof.

Figure 2:
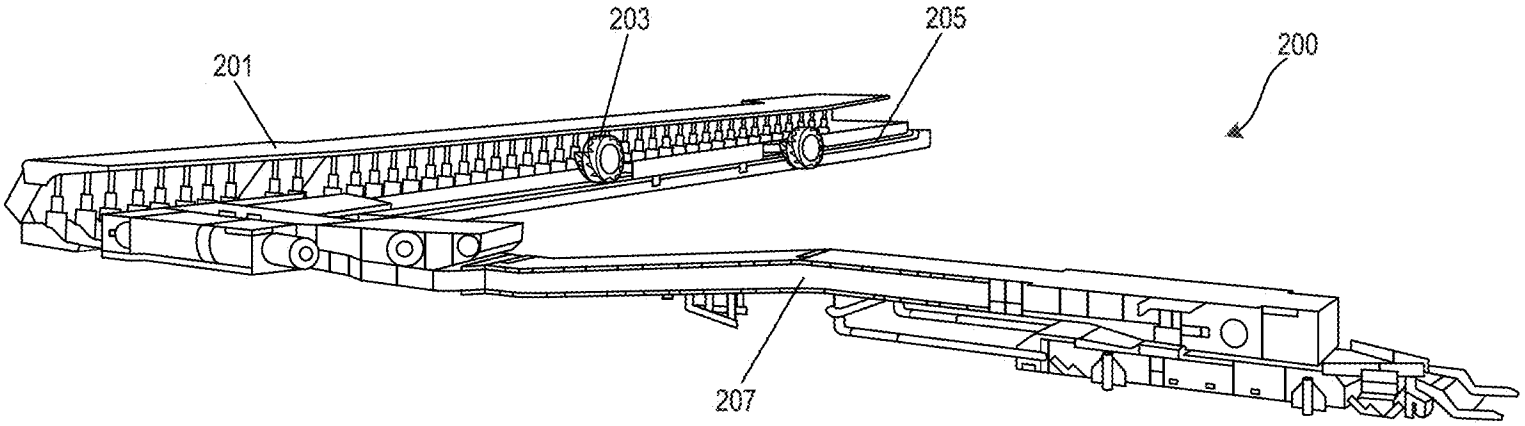
FIG. 2 is a perspective view of a longwall mining system including a series of the powered roof supports of FIG. 1.

FIG. 2 illustrates an example of a longwall mining system 200 including a series of PRSes 201 arranged in a generally linear array. The longwall mining system 200 also includes a shearer 203 positioned and controlled to move along the series of PRSes 201. As the shearer 203 is moved past the series of PRSes 201, the shearer 203 rotates to cut into the material of the mine face. An armor faced conveyor (AFC) 205 is also positioned along the series of PRSes 201 underneath the shearer 203. As the shearer 203 cuts into the mine face, the cut material falls on the AFC 205 and moves along the AFC 205 toward a beam stage loader 207, which then moves the cut material toward the surface and out of the mining area. The shearer 203 and the AFC 205 are coupled to a stage loader 207 such that, after the shearer 203 completes a cutting pass along the mine face, the shearer 203 and the AFC 205 advance away from the series of PRSes 201 and toward the mine face so that the shearer 203 can begin another cutting pass across the mine face.

In various arrangements and implementations, the individual components of the longwall mining system 200 may each be controlled by their own internal electronic controller. In some such implementations, these multiple electronic controllers are further configured to communicate with each other, for example, through a wired or wireless device area network or a communication bus to coordinate the operation of the individual components. Alternatively, the components of the longwall mining system 200 may be controlled by a central longwall control system that sends commands and operational signals to the individual component controllers and/or provides control signals directly to operation components to provide for the coordinated operation of the longwall mining system 200.

Figure 3:
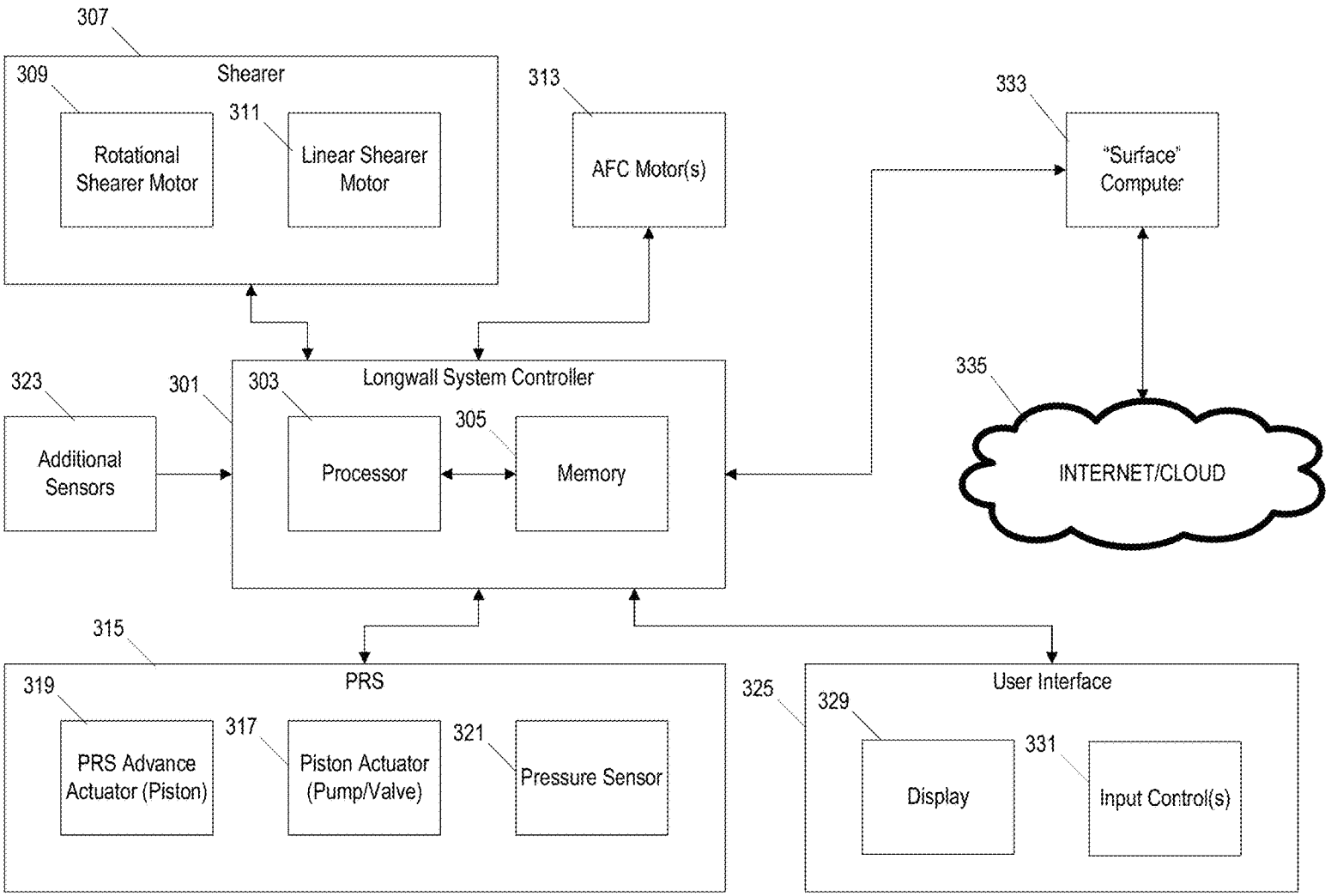
FIG. 3 is a block diagram of a control system for the longwall mining system of FIG. 2.

In the example of FIG. 3, a longwall system controller 301 includes a processor 303 and a memory 305. The memory 305 stores instructions that are executed by the processor 303 to control the operation of the longwall system controller 301. The longwall system controller 301 is communicatively coupled to the shearer 307 and provides signals and/or commands to regulate the operation of the rotational shearer motor 309 and the linear shearer motor 311 that moves the shearer blade past the series of PRSes along the mine face. In some implementations, the shearer 307 includes a local shearer controller (not pictured) which communicates with the longwall system controller 301 and, in turn controls the operation of the rotation shearer motor 309 and the linear shearer motor 311. In other implementations, the longwall system controller 301 transmits control signals directly to the rotational shearer motor 309 and the linear shearer motor 311. Similarly, the longwall system controller 301 is also communicatively coupled to the AFC motors 313 of the conveyor system and regulates the operation of the AFC motors 313 either directly or through one or more local belt/crusher controllers.

The longwall system controller 301 is also communicatively coupled to each individual PRS 315 and regulates the operation of the piston actuator 317 to raise or lower the canopy of the PRS 315. In this example, a pump station (not pictured) is positioned remotely from the series of PRSes. The pump station is coupled to the series of PRSes by a system line which provides pressurized hydraulic fluid to the series of PRSes and a return line. The pump station is operated to maintain pressure in the system line. In this example, the piston actuator 317 of each individual PRS 315 includes a solenoid-type valve that controllably opens the PRS cylinder to the return line to controllably reduce the pressure in the cylinder (e.g., to lower the PRS) and to the system line to fill the PRS cylinder with pressurized fluid—thereby increasing the fluid pressure within the cylinder and, in some cases, raising the PRS. The piston actuator mechanism 317 for each individual PRS 315 also includes a "check valve" (i.e., a pressure relief valve) that automatically opens to atmosphere and releases hydraulic fluid to reduce the pressure within the cylinder when the fluid pressure within the cylinder exceeds a threshold.

Although in the example of FIG. 3, a single pump station provides system and return lines to all of the PRSes in the longwall mining system and the piston actuator 317 includes a valve (or valves) regulating pressure between the individual PRS 315 and the remotely located pump station, in other implementations, each the piston actuator 317 for each individual PRS 315 might include a controllable pump system that pumps hydraulic fluid into the piston of only an individual PRS 315 to raise the canopy of the PRS 315 (or to increase the pressure applied by the canopy against the mine roof). Furthermore, although the check valve component in this example is described as a mechanical valve that opens automatically when the internal fluid pressure exceeds a threshold, in some implementations, the return line valve of the piston actuator 317 is controlled by a controller to operate as a "check valve."

The longwall system controller 301 in the example of FIG. 3 also coordinates the operation of a PRS advance actuator 319 for each individual PRS 315. The operation of the PRS advance actuator 319 causes the PRS to advance toward the mine face after the shearer moves past the PRS 315 (as described in further detail below). In some implementations, the PRS advance actuator 319 includes a controllable hydraulic piston coupling the PRS to the AFC. After the PRS canopy is lowered, the piston retracts and pulls the PRS toward the AFC and the shearer. In some such implementations, the controllable hydraulic piston of the PRS advance actuator 319 also operates to advance the shearer and the AFC toward the mine face after the PRS is set into a new position against the mine roof by expanding the hydraulic piston and pushing the shearer and AFC toward the mine face.

The longwall system controller 301 is also configured to receive a pressure value from each PRS 315 indicative of the pressure exerted between the PRS canopy and the mine roof. In the example of FIG. 3, each PRS 315 includes a pressure sensor 321 that monitors the fluid pressure within the cylinder and operates the valve(s) of the PRS accordingly to regulate fluid pressure received from or returned to the pump station. However, in other embodiments, the system may be configured to indirectly determine fluid pressure using other mechanisms. For example, in implementations where each individual PRS 315 is equipped with its own dedicated fluid pump, the fluid pressure within the piston cylinder might be estimated based on the current power draw of the pump. As discussed in further detail below, some implementations of the longwall control system 301 are configured to monitor the status of mine roof and to adjust operation of the longwall mining system 200 based on the pressure values received from each PRS 315.

In addition to the pressure values received from each PRS 315, the longwall control system 301 is also communicatively coupled to additional sensors 323 and configured to receive additional information regarding the current conditions/operation of the longwall mining system 200 including, for example, speed, position, etc. of the longwall mining system components and conditions of the mine itself including, for example, temperature and humidity. This and other information may be output by the longwall system controller 301 to a user interface 325. The user interface 325 is positioned proximate to an operator of the longwall mining system, in some implementations, within the mine itself and includes a graphical display 329 and one or more input controls 331.

The longwall system controller 301 is also communicatively coupled to one or more computer systems positioned out of the mine at a location on the surface (e.g., a "surface" computer" 333). In some implementations, the surface computer 333 is also communicative coupled to the Internet or other network/cloud resources 335 to exchange mining conditions/operations information with other remotely located computer systems. For example, the surface computer 333 may be configured to connect with a centralized server that collects mining operational data from multiple different mines and uses the collected information to optimize and improve mining performance.

The surface portion of the control system may include one or more servers or other computers that are electrically connected to each other and to the longwall system controller 301 by a computer network or networks. The servers, computers, and longwall system controller 301 are capable of communicating using one or more network protocols including, for example, TCP/IP, UDP, supervisory control and data acquisition (SCADA), and OLE for process control (OPC). The servers and computer may also be connected to outside wide area networks including, for example, a corporate network or the Internet 335. In some such implementations, the longwall system controller 301 sends event, alarm, and sensor data from the mining system to the servers and computers using one or more methods. For example, the longwall system controller 301 may send data directly to a database on the surface (e.g., a MySQL database). Alternatively or additionally, UDP packets received by the longwall system controller 301 from the various components and sensors of the longwall mining system 200 are converted into OPC data and consolidated into flat files, which are then sent to the surface computer 333. The files can then be stored locally or sent to a central database at another location via the Internet or other network 335. The data stored on the surface can then be used to generate reports used to design and optimize future mining plans.

Figure 4A:
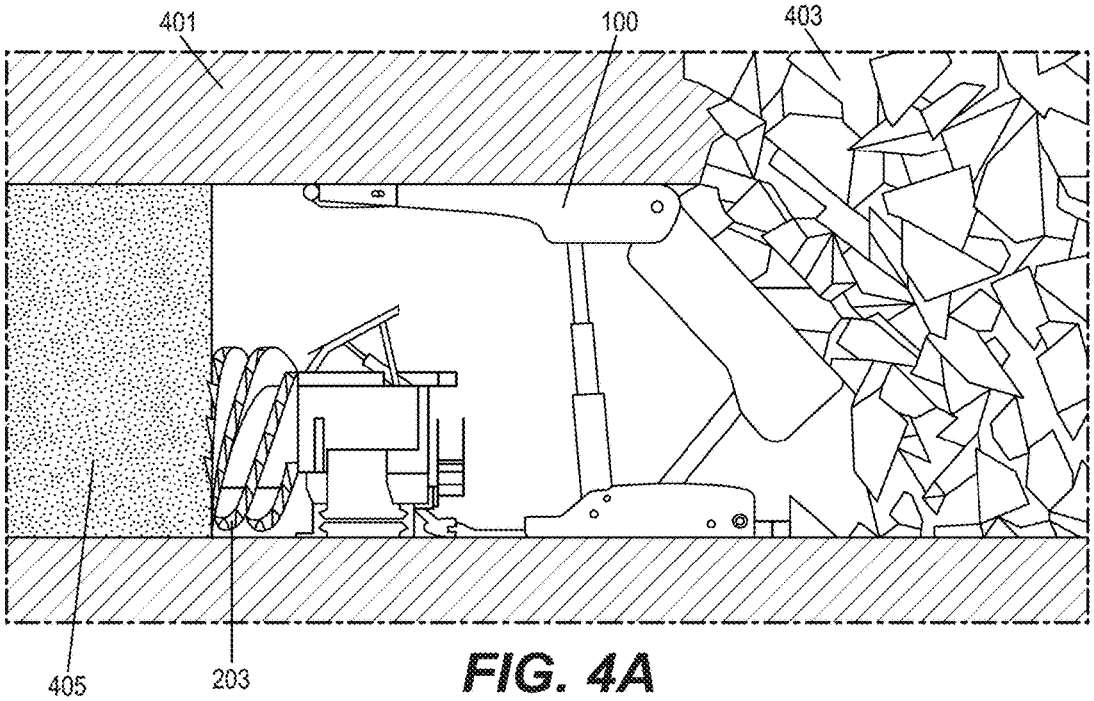
FIG. 4A is a side elevation view of the longwall mining system of FIG. 2 as the shearer passes a powered roof support.
Figure 4B:
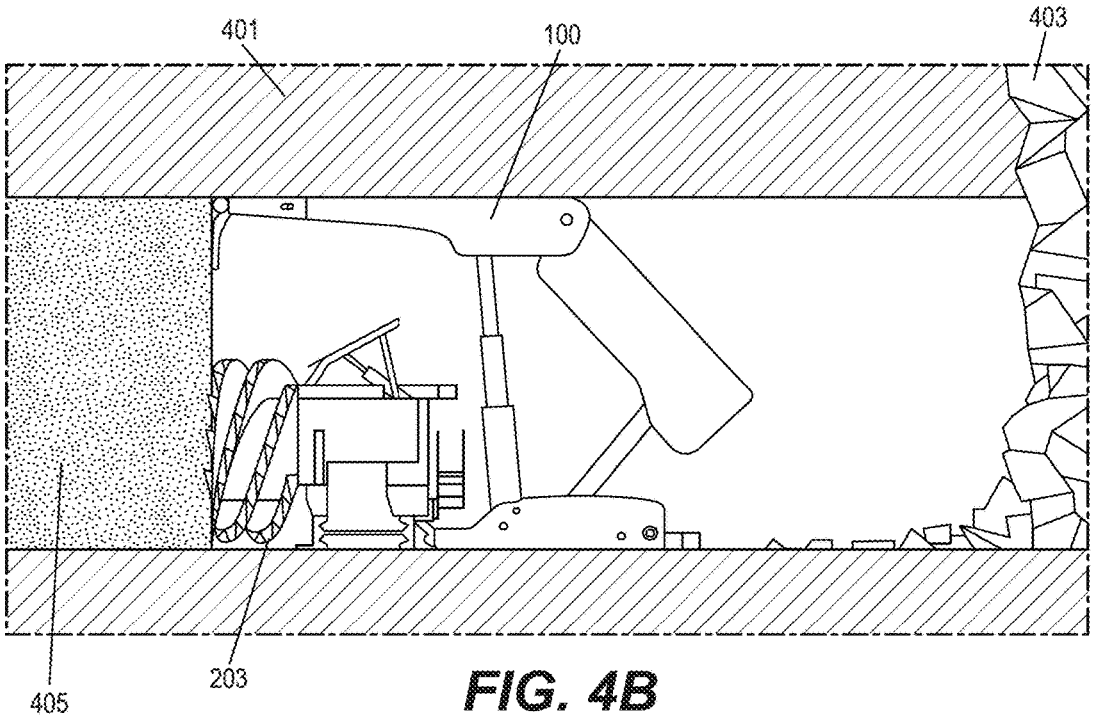
FIG. 4B is a side elevation view of the longwall mining system of FIG. 2 after the shearer has passed the powered roof support and the power roof support has been advanced toward the shearer.

FIGS. 4A and 4B illustrate the operation of the longwall mining system 200 during coal mining. As discussed above, the shearer 203 moves past each PRS 100 cutting into the coal face 405 along a longwall. After each cutting pass, the shearer 203 is advanced further into the coal face 405. With each subsequent cutting pass, each individual PRS 100 is also advanced toward the coal face 405 thereby continuing to support the mine roof 401 above the shearer 203 while the mine roof is allowed to collapse behind the PRS 100 (i.e., opposite the shearer 203). This collapsed portion of the mine roof 401 behind the PRS 100 is called the gob 403.

As shown in FIG. 4A, each individual PRS 100 is positioned with a gap between the PRS 100 and the path of the shearer 203 before the shearer 203 passes the PRS 100. As the shearer 203 moves past each individual PRS 100, the PRS 100 is lowered and advanced toward the coal face 405. As shown in FIG. 4B, the PRS 100 has been advanced, thereby removing the gap between the PRS 100 and the path of the shearer 203. As illustrated in FIG. 4B, the mine roof 401 has not yet collapsed immediately behind the PRS 100. However, as more PRSes are subsequently advanced toward the coal face 405, the unsupported weight of the roof behind the series of PRSes increases until the roof does collapse.

Figure 5:
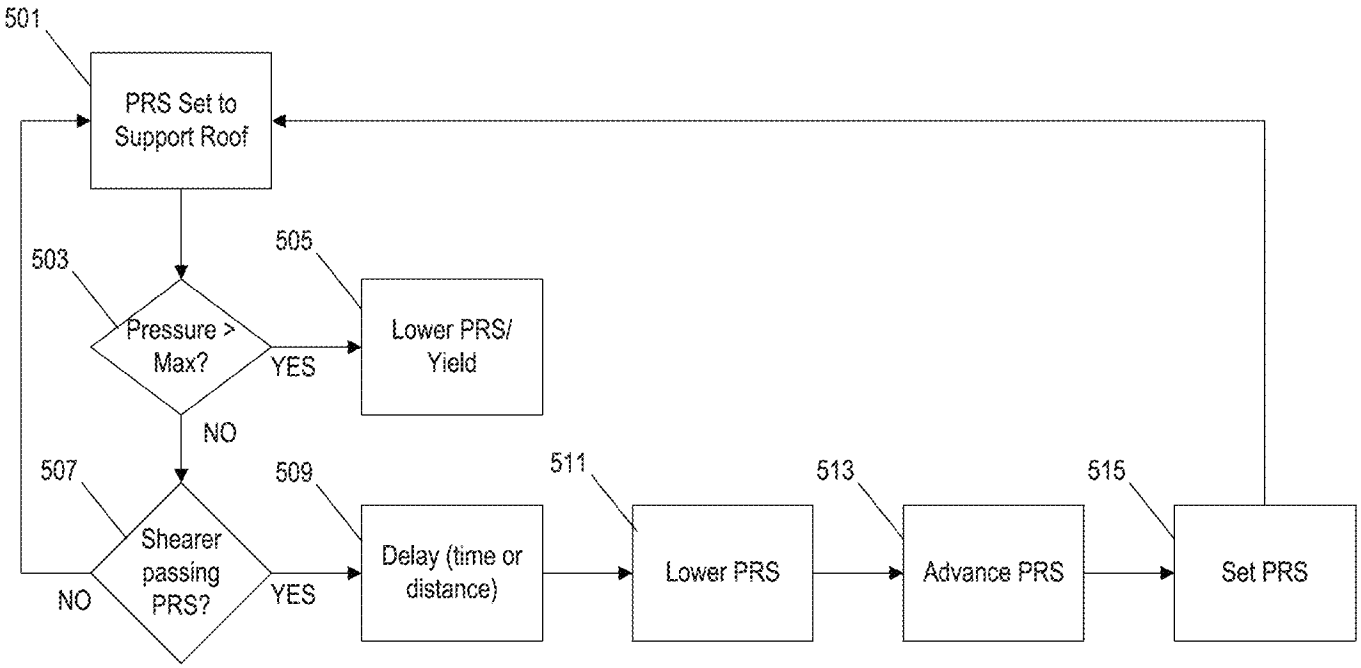
FIG. 5 is a flowchart of a method for operating a powered roof support in the longwall mining system of FIG. 2 as the shearer moves along the longwall face.

FIG. 5 illustrates how the longwall system controller 301 operates each individual PRS 100 to advance toward the coal face 405 as illustrated in FIGS. 4A and 4B. After the PRS is set to support the mine roof (step 501), the longwall system controller 301 continues to monitor the pressure on the individual PRS and determine whether that pressure exceeds a maximum yield threshold (step 503). If the yield threshold is exceeded, the "check valve" of the PRS is triggered. The triggering of the check valve protects the mining equipment by lowering the PRS and reducing the pressure (step 505). However, if the maximum yield threshold is not exceeded and the check valve has not been triggered, the PRS continues to support the mine roof until the shearer passes the PRS (step 507). Once the shearer has passed the PRS, the longwall system controller waits for a defined delay period (step 509). In this example, the delay period is defined as a distance that the shearer must travel along its path after passing the specific PRS. Once the delay has expired (i.e., once the shearer has moved the defined distance away from the PRS), the longwall system controller 301 lowers the PRS (step 511), advances the PRS toward the coal face (step 513), and sets the PRS to support the mine roof at a new location (step 515). Ideally, the portion of the mine roof behind the PRS will then collapse after the PRS is set at its new location. In this example, the lower-advance-set (LAS) cycle of the PRS is initiated when the distance between the shearer and the PRS reaches a defined threshold distance. However, in other implementations, the delay is defined in terms of a period of time such that the LAS cycle is initiated at a defined period of time after the shearer has passed an individual PRS.

The process illustrated in FIG. 5 is repeated for each individual PRS and for each cutting pass that the shearer makes along the coal face. As such, each individual PRS is advanced in sequence as the shearer moves along its path on each individual cutting pass. Similarly, under ideal conditions, the collapse of the mining roof will propagate behind each individual PRS after each PRS is set at its new position. Therefore, in certain circumstances, the movement of the shearer along the coal face, the sequential advancement of each PRS, and the propagation of the roof collapse behind the PRSes will manifest as phase-shifted, generally-periodic sequences. However, this ideal phase-shifting does not always occur and, if the mine roof does not fall behind the PRS, the weight supported by each PRS will continue to increase as the PRS advances and the unsupported portion of the mine roof behind the PRSes will continue to grow. In some situations, this additional pressure can cause the coal face 405 to collapse in toward the mining system creating a void ahead of the machine. In other situations, the weight of the unsupported mine roof may continue to increase until a sudden collapse of a large portion of the mine roof occurs. In still other situations, the weight of the mine roof on an individual PRS may increase beyond the maximum yield threshold thereby causing the check valve to release pressure and lower the PRS to prevent damage to the mining equipment. If one or more of the PRSes are completely lowered due to excessive pressure, the control system will not be able to controllably lower the PRS canopy off of the mine roof and, therefore, will not be able to advance that PRS toward the mine face so that it can be re-set at a new location. If the longwall mining system is no longer be able to advance the PRSes toward the coal face due to pressure release through the check valve, mining operations may need to be suspended or delayed.

Figure 6:
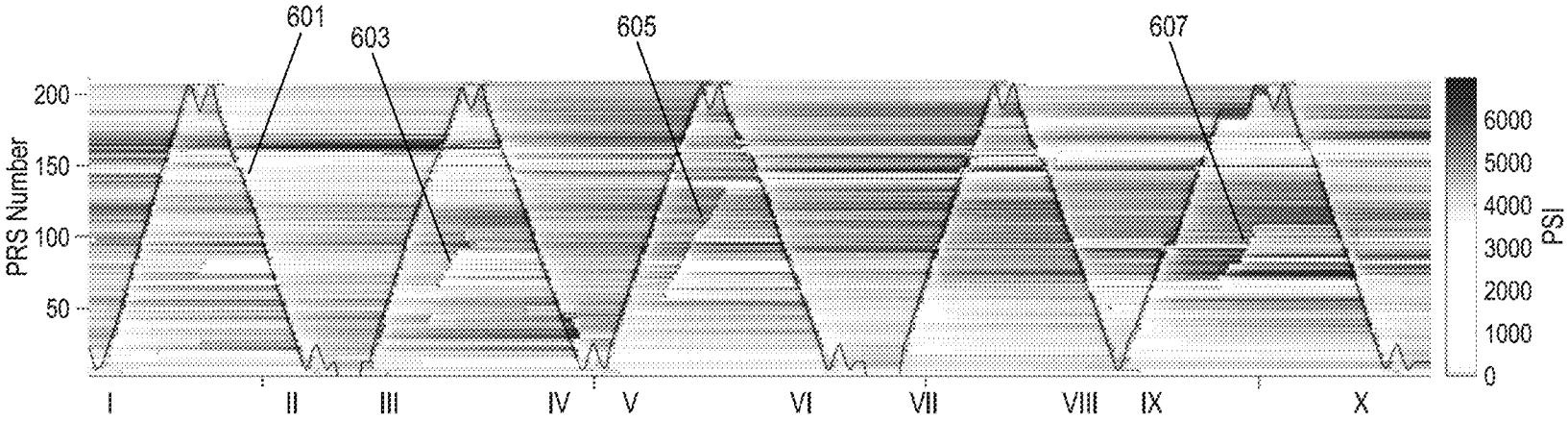
FIG. 6 is a pressure map generated and displayed on the display screen of the mining system of FIG. 3 indicating the position of the shearer and the pressure on each powered roof support over a period of time.

In some implementations, the longwall mining system 200 of FIG. 2 and the longwall system controller 301 of FIG. 3 are configured to continually monitor pressures exerted on each PRS to monitor mine roof collapses, to evaluate the propagation of mine roof collapses, and, in some such implementations, adjust the operation of the longwall mining system 200 to improve the propagation of mine roof collapses. FIG. 6 illustrates an example of a "pressure map" generated by the longwall system controller 301 based on pressure values received from each PRS in the longwall mining system 200. In some implementations, this pressure map is shown on the display 329 of the user interface 325 and analyzed to determine qualitative and quantitative information regarding mine roof collapses.

The pressure map of FIG. 6 includes a series of color-coded horizontal lines—each corresponding to a different individual PRS in the series of PRSes. The color of each individual line is varied to indicate the pressure on each individual PRS over a period of time. For example, in some implementations, the color of an individual line will darken or intensify as the pressure on the corresponding individual PRS increases and will lighten as the pressure on the corresponding PRS decreases. A solid line 601 is overlaid onto the pressure map to indicate the position of the shearer over the same period of time. The point at which the solid line 601 passes an individual, color-coded line corresponding to an individual PRS indicates the time at which the shearer physically moves past that same PRS in the mine.

In the example of FIG. 6, the pressure map illustrates PRS pressure data and the corresponding position of the shearer for a total of ten cutting passes along the coal face—each cutting pass of the shearer is identified by a Roman numeral I-X. When shown on the display 329 of the user interface 325, the generated pressure map provides information to the operator of the longwall mining system regarding the condition of the mine roof. In some implementations, the longwall system controller 301 is also configured to analyze the generated pressure map to detect and quantify various conditions of the mine roof which can then be used to adjust the operation of the longwall mining system 200.

In some implementations, under ideal conditions, a portion of the mine roof behind each individual PRS will collapse as the PRS is raised and "set" at a new position (or shortly thereafter). For example, during the first cutting pass (Pass I in FIG. 6), the pressures across the mine face seem to drop uniformly as the shearer line 601 passes. This is indicative of a gradual mine roof collapse that follows closely with the movement of the shearer and the LAS cycle of each PRS.

However, by the third cutting pass (Pass III in FIG. 6), at least a portion of the mine roof is not collapsing as the LAS cycle is completed. Instead, after the PRS is re-set at a new position, the fluid pressure in the PRS quickly rises to its pre-LAS level. Furthermore, instead of following in phase with the LAS cycle, a portion of the mine roof collapses between the third cutting pass (Pass III) and the fourth cutting pass (Pass IV). This delayed collapse event is visible and detectable in the pressure map of FIG. 6 as a series of pressure drops in adjacent PRSes forming a generally linear line 603 in the pressure map data. This visible "line" 603 is indicative of sudden changes in pressure across several adjacent PRSes in the longwall mining system and generally indicates that the longwall roof has gradually collapsed behind the group of PRSes thereby sequentially reducing the pressure on each respective PRS as the collapse propagates—albeit, at a time-shifted delay from the LAS cycle.

The example of FIG. 6 also shows a second visible "line" 605 between the fifth cutting pass (Pass V) and the sixth cutting pass (Pass VI). A third visible line 607 indicative of a roof collapse event is also present between the ninth cutting pass (Pass IX) and the tenth cutting pass (Pass X) of the shearer. As discussed in further detail below, this example indicates a series of abnormal mine roof collapses with, in some cases, multiple cutting passes of the shearer occurring between roof collapse events.

Figure 7A:
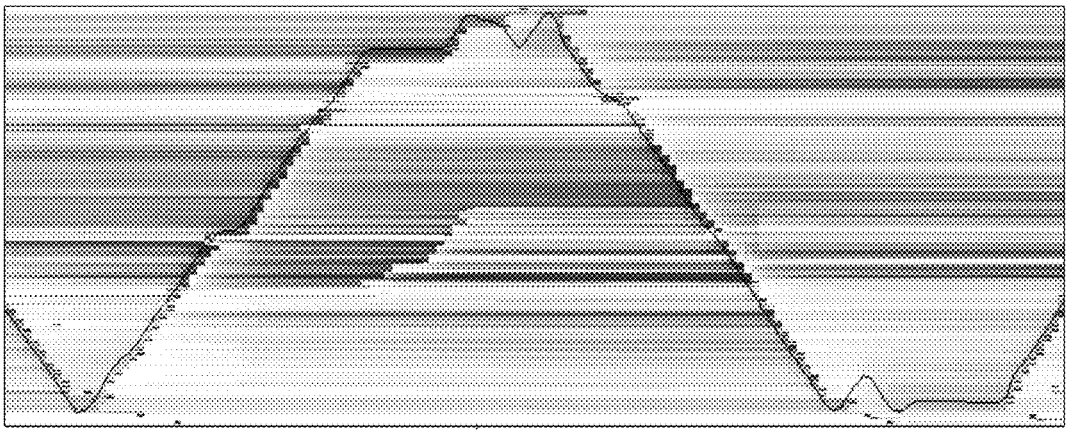
FIG. 7A is a section of the pressure map displayed using color-coding to represent pressures on each powered roof support in the mining system of FIG. 2.
Figure 7B:
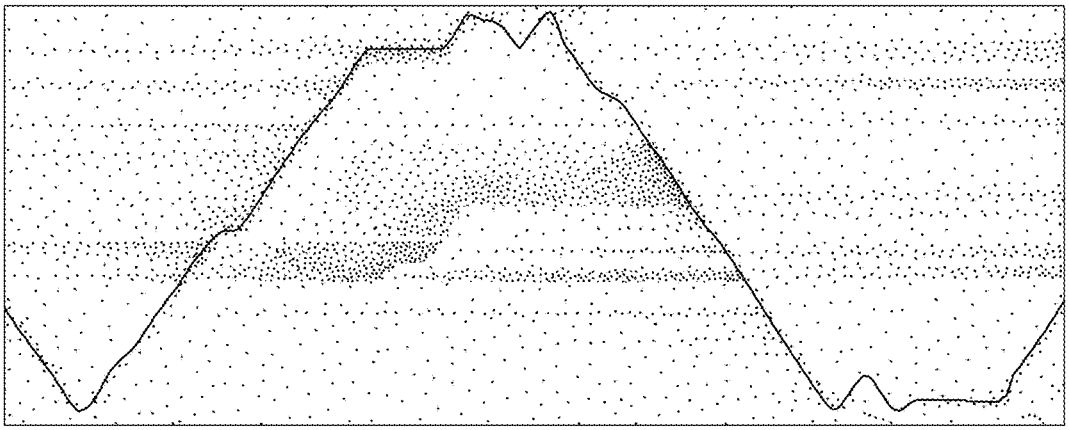
FIG. 7B is the same section of the pressure map of FIG. 7A displayed using an alternative pressure density format to represent pressures on each powered roof support in the mining system of FIG. 2.
Figure 7C:
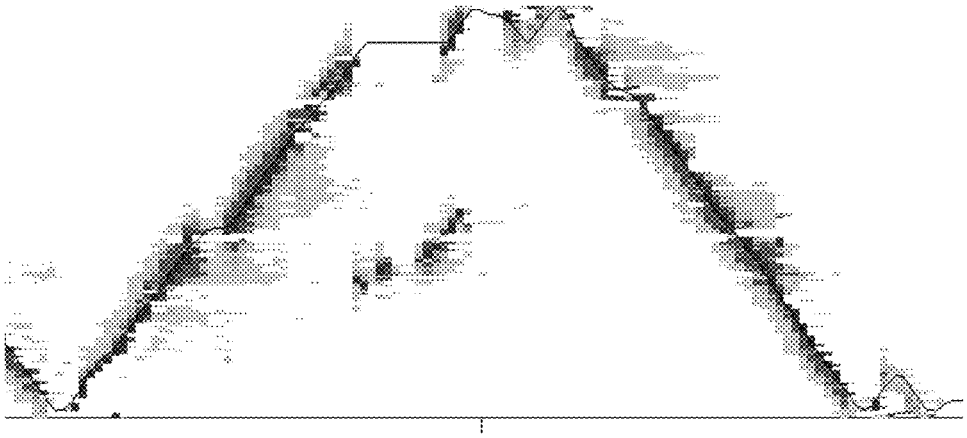
FIG. 7C is the same section of the pressure map of FIG. 7A displayed to show a pressure differential indicative of rapid changes in pressure on each powered roof support in the mining system of FIG. 2.

The example of FIG. 6 illustrates a color-coded pressure map where pressures on each PRS are illustrated using variations in color. However, other implementations may use other display formats for showing the pressure map on the display 329 of the user interface 325. FIGS. 7A, 7B, and 7C illustrate three examples of possible display/format mechanisms. The example of FIG. 7A shows a pressure map illustrating PRS pressures and the corresponding position of the shearer over two cutting passes using the same color-coded display scheme as in the example of FIG. 6 (demonstrated in this disclosure using grayscale). FIG. 7B illustrates an alternative format for displaying pressure values for the same two cutting passes using stippling density—in particular, the relative density of the stippling marks increases as the pressure on a PRS increases and lower density of stippling correspondingly indicates a lower pressure on the PRS. This alternative display format may be particularly useful when using a monochromatic (e.g., black and white) display device.

Lastly, FIG. 7C illustrates another display format for the same two cutting passes as illustrated in FIGS. 7A and 7B. In the example of FIG. 7B, instead of illustrating an absolute pressure on each PRS, the graph illustrates relative changes in pressure. More specifically, the colored pixels indicate times at which a change in pressure on each individual PRS exceeded a threshold. In some implementations, a pressure differential map includes a color-coding scheme to demonstrate the relative magnitude of the pressure change. However, in other implementations, a monochromatic pressure differential map may be generated that simply identifies each individual pixel corresponding to a change in pressure on each PRS that exceeds a defined pressure differential threshold.

In some implementations, the longwall system controller 301 is configured to show only one type of pressure map on the display 329. However, in other implementations, the longwall system controller 301 may be configured to simultaneously display multiple different pressure maps or to receive a selection from a user indicating the type of pressure map to be shown on the display 329.

Figure 8:
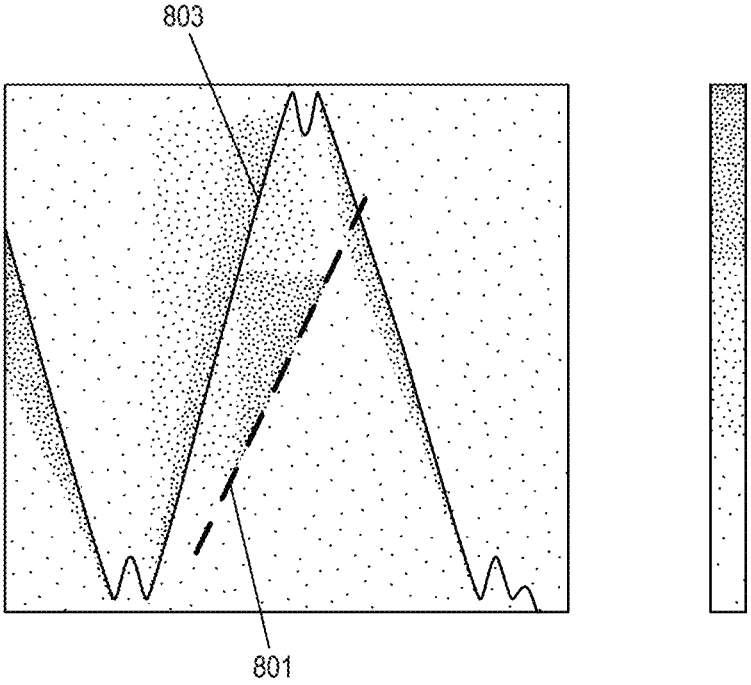
FIG. 8 is pressure map illustrating a first example of a collapse of the mine roof as the shearer moves across the longwall face.
Figure 9:
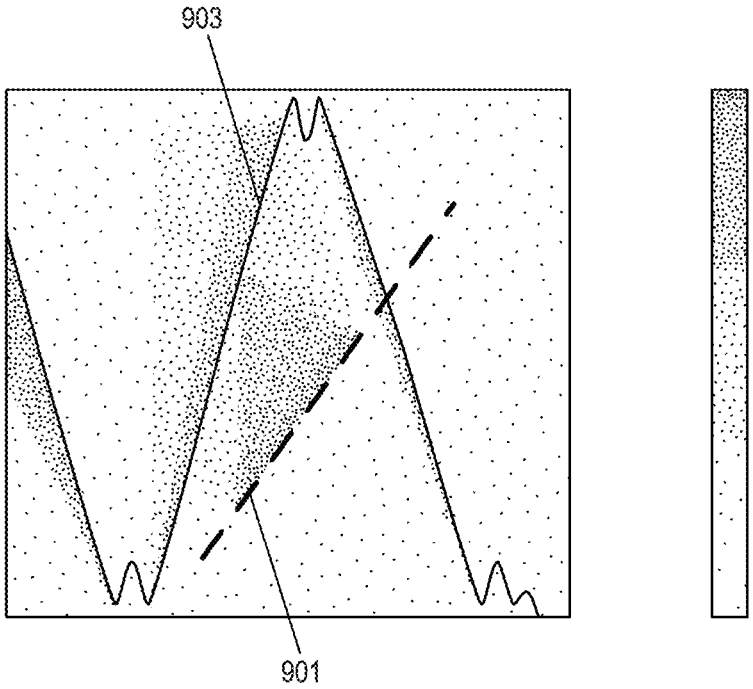
FIG. 9 is a pressure map illustrating a second example of a collapse of the mine roof in which the speed at which the mine roof collapse propagates across the longwall mine face lags the speed of the shearer.
Figure 10:
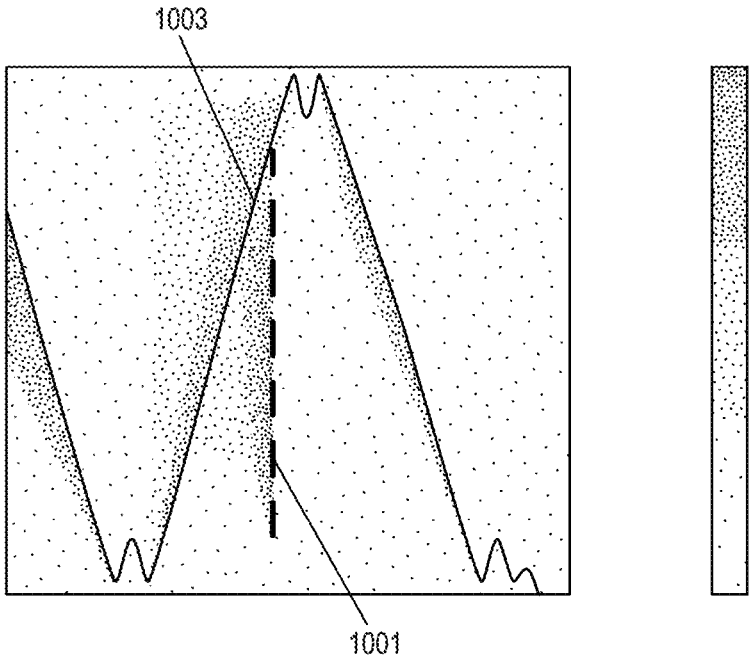
FIG. 10 is a pressure map illustrating a third example of a collapse of the mine roof in which a sudden collapse of the mine roof occurs across several powered roof supports.

As discussed above, the pressure map generated by the longwall system controller 301 can be further analyzed to provide qualitative information regarding each individual mine roof collapse event. In some implementations, this qualitative information is then used by the longwall system controller 301 to adjust the operation of the longwall mining system 200. FIGS. 8-10 illustrate different examples of mine roof collapse events as represented in the pressure maps generated by the longwall system controller 301.

The example of FIG. 8 shows a mine roof collapse that generally follows the movement of the shearer and, therefore, the advancement of the PRSes. The line 801 exhibited by the pressure data indicative of a propagating mine roof collapse is not exactly parallel with corresponding portion of the line 803 representing the position of the shearer and, therefore, the propagating mine roof collapse is not exactly a "phase-shift" of the shearer movement. Furthermore, the temporal distance between the shearer position line 803 and the detectable roof collapse line 801 suggests that the mine roof may not be collapsing as soon after the LAS cycle as might be preferred.

In the example of FIG. 9, in addition to exhibiting a temporal difference between the roof collapse line 901 and the shearer position line 903, the difference between the slope of the roof collapse line 901 and the portion of the line 903 representing the position of the shearer is even greater. Therefore, in some implementations and under some mining conditions, the longwall system controller 301 may be configured to detect this difference and to qualitatively determine that the mine roof collapse event is more stably controlled by the operation of the longwall mining system 200 in the example of FIG. 8 and, when encountering the pressure data in the example of FIG. 9, may make adjustments to the operation of the longwall mining system 200 to improve the correlation between the movement of the shearer and the propagation of the mine roof collapse.

FIG. 10 illustrates yet another example in which the line 1001 exhibited in the pressure data indicative of the mine roof collapse event is substantially vertical and bears little similarity to the portion of the line 1003 representing the position of the shearer. In this example, the sudden decrease in pressure across multiple PRSes is indicative of a sudden collapse of a large portion of the mine roof as opposed to the controlled, gradual propagation of the mine roof collapse. In some implementations, when the slope of the liner 1001 indicates a sudden collapse, an alert may be sent from the longwall system controller 301 to the surface computer 333 and operation of the longwall mining system 200 may be suspended until the condition of the longwall mining system 200, the mine, and any mine personnel can be further evaluated and it is confirmed that mining operations can continue despite the sudden collapse of the mine roof.

It should be understood that, although the examples of FIGS. 8, 9, and 10 discuss detecting a line with a positive slope, this is due to how the information is displayed in the given example. Because the shearer moves back and forth along the mine face, collapse events would also be detected in the pressure map data as a line of sudden pressure changes with a negative slope—particularly after the shearer passes that are also displayed as having a negative slope on the line overlaid onto the pressure map.

In some implementations, a user of the longwall mining system 200 or a user monitoring the operation of the longwall mining system 200 at the surface computer 333 might visually inspect the pressure map generated by the longwall system controller 301 and make manual adjustments to the operation of the longwall mining system 200. However, in at least some implementations, the longwall system controller 301 is configured to analyze the pressure data from the pressure map and to automatically adjust the operation of the longwall mining system accordingly.

Figure 11:
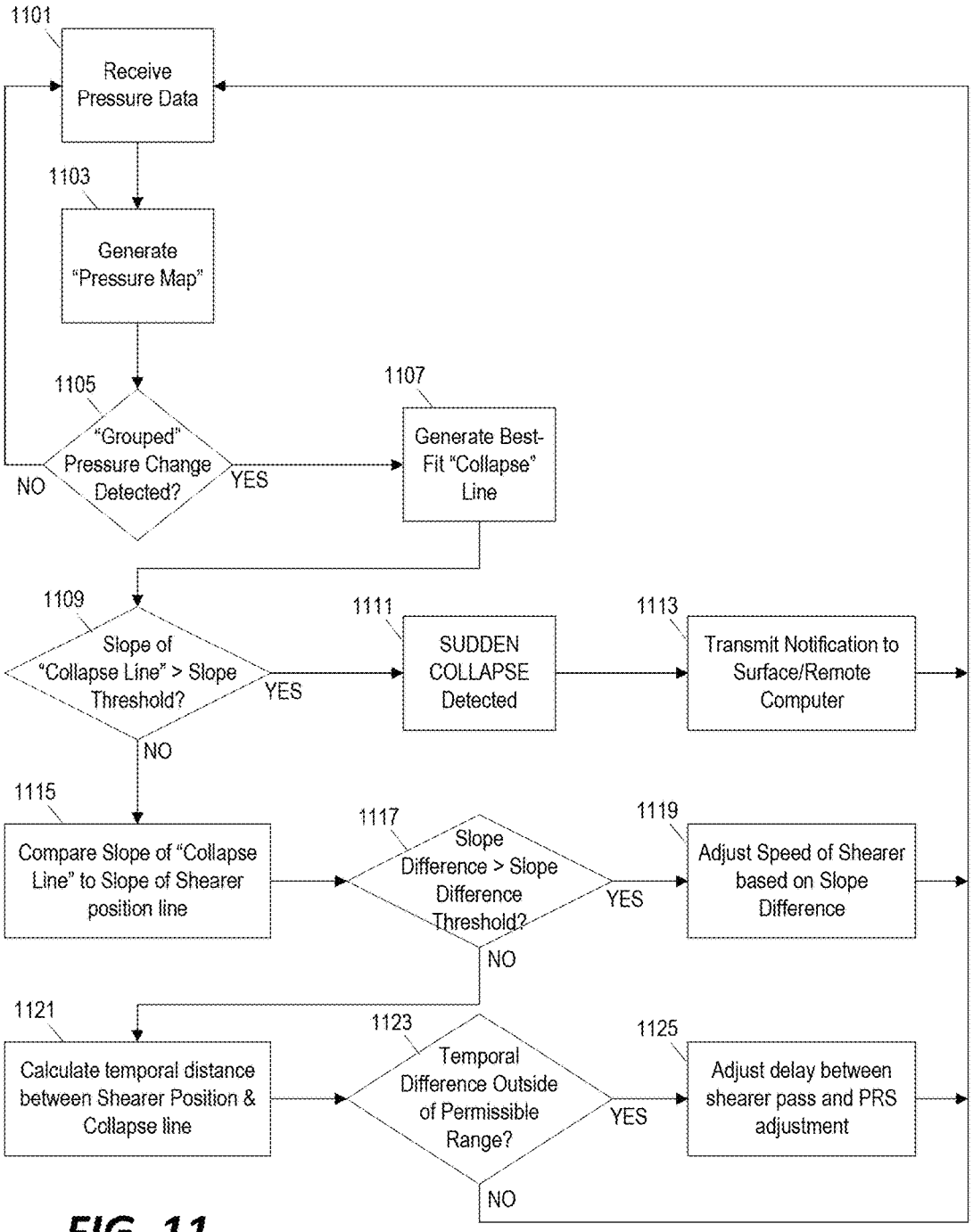
FIG. 11 is a flowchart of a method for adjusting the operation of the longwall mining system of FIG. 2 based on observed and detected roof collapse information.

FIG. 11 illustrates on example of how the longwall system controller 301 may be configured to automatically optimize/adjust the operation of the longwall mining system 200 based on observed pressure map data. The longwall system controller 301 continuously receives pressure data from each of the individual PRSes in the longwall mining system 200 (step 1101) and generates a pressure map (step 1103). The longwall system controller 301 then evaluates the pressure data and the generated pressure map. When a "grouped" pressure change (e.g., temporally related pressure changes across multiple adjacent PRSes) is detected (step 1105), the longwall system controller 301 generates a best-fit "collapse line" based on the pressure data (step 1107). In this example, the slope of the "collapse line" is first compared to a slope threshold (step 1109) and, if the slope threshold is exceeded, the longwall system controller 301 determines that a "sudden collapse" has occurred (step 1111) and transmits a notification or alert signal to the user interface 325, the surface computer 333, or a remote computer system through the Internet 335 (step 1113) (e.g., the scenario illustrated in FIG. 10).

If the slope of the collapse line is less than the slope threshold and the longwall system controller 301 determines that the collapse event is not a "sudden collapse," but rather a propagating collapse, then the slope of the collapse line is compared to the slope of a corresponding portion of the shearer position line (step 1115). If the slope difference exceeds a defined "slope difference threshold" (step 1117), then the longwall system controller 301 determines that the shearer is moving too fast or too slowly to regulate the propagation of the mine roof collapse (e.g., the scenario illustrated in FIG. 9). The speed of the linear movement of the shearer along the coal face is adjusted based on the calculated slope difference (step 1119) so that the slope of the shearer position line more closely matches the slope of the collapse line.

If the slope of the collapse line generally matches the slope of the shearer position line (step 1117), then the longwall system controller 301 determines that the speed of the linear movement of the shearer is appropriate. The longwall system controller 301 then evaluates the current control scheme for advancing the PRSes based on the pressure data. In particular, the longwall system controller 301 calculates an average temporal distance between the shearer position and the collapse line (step 1121) (e.g., the average Y-distance between the collapse line 801 and the shearer position line 803 for each PRS on the X-axis of the pressure map). If the average temporal distance between the collapse line and the shearer position line is beyond a defined permissible range (step 1123), then the longwall system controller determines that the roof collapse behind each PRS is occurring either too soon or too long after the advancement of each individual PRS and will adjust the delay between the shearer pass and the PRS adjustment accordingly (step 1125).

For example, if the average temporal distance between the shearer position and the collapse line is too large, then the total weight of the mine roof supported by the PRSes will be similarly large. In response to detecting this condition, the longwall system controller 301 may decrease the defined delay period so that each individual PRS is advanced sooner after the shearer passes and thereby facilitating an earlier collapse of the mine roof behind the PRS.

Figures 12A, 12B, 13:
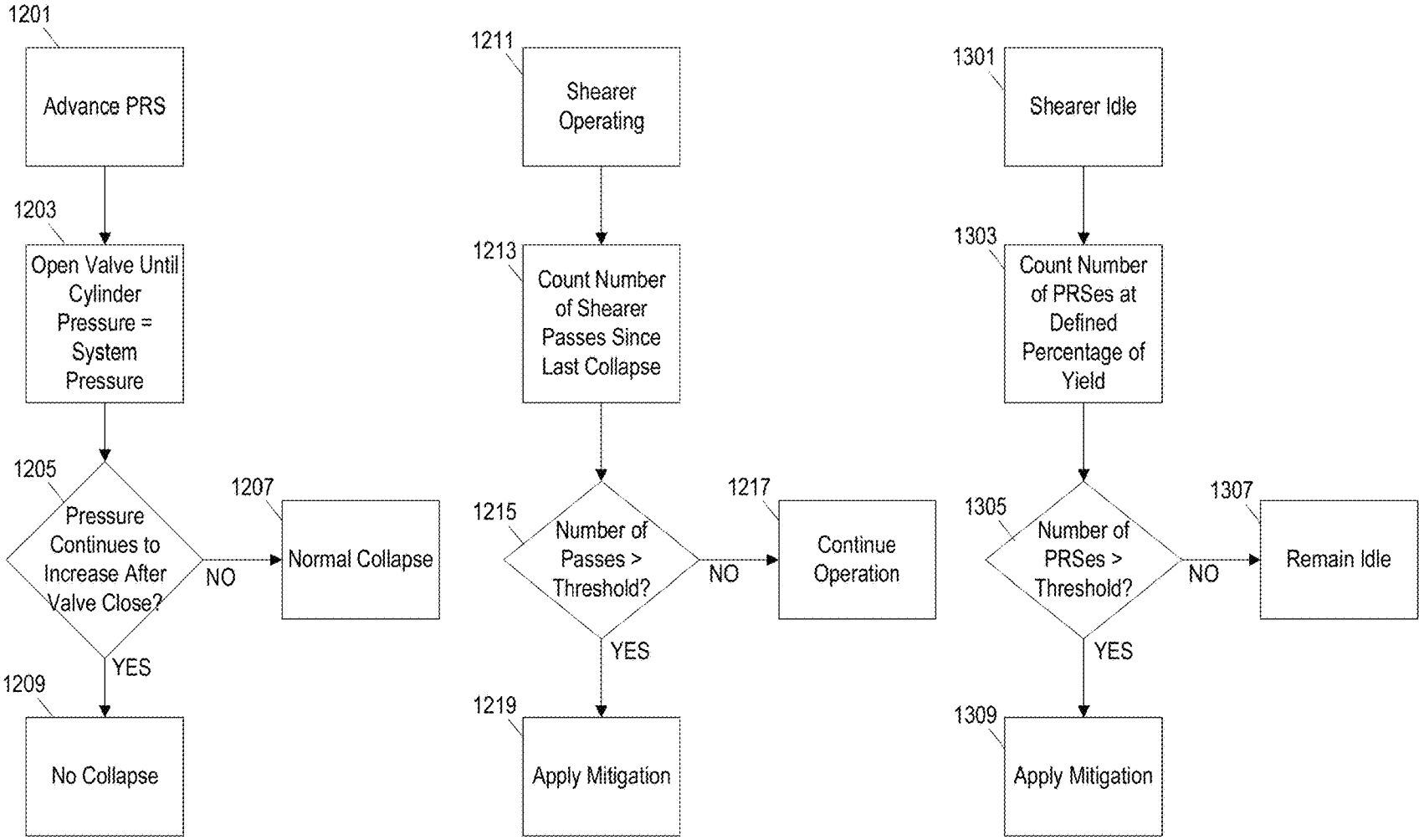
FIG. 12A is a flowchart of an alternative method for detecting a collapse of the mine roof
FIG. 12B is a flowchart of a method for detecting a condition where the shearer has made multiple passes along the longwall mine face without a collapse of the mine roof behind the powered roof supports.
FIG. 13 is a flowchart of a method for detecting a condition in which roof pressure conditions have changed while the shearer is idle.

As discussed above, in some mining situations and in some implementations of the longwall mining system, the roof collapse would ideally occur as the PRS is re-set at the end of an LAS cycle (or shortly thereafter). Under such conditions, a "collapse line" may not may not be visible in the pressure map data between the cutting passes of the shearer. As such, the longwall system controller 301 may be further configured to detect whether a portion of the mine roof has collapsed by monitoring the fluid pressure within a cylinder as the PRS is raised at a new position. FIG. 12A presents one such example for detecting normal collapse events as the PRS is re-set. After the PRS is advanced to a new position (step 1201), the valve on the piston cylinder is opened, thereby increasing the pressure within the piston cylinder until it reaches a threshold (e.g., the fluid pressure within the "system" line from the pump station) (step 1203). After the fluid pressure reaches the threshold, the valve is closed and the longwall system controller 301 continues to monitor the fluid pressure within the cylinder (step 1205). If the fluid pressure does not immediately increase after the valve is closed (or if the rate of the increase is similarly below a threshold), then the longwall system controller 301 concludes that the PRS is not supporting excessive weight of an uncollapsed mine roof and, therefore, a normal collapse of the mine roof has occurred following the completion of the LAS cycle (step 1207). However, if the pressure continues to increase at a rapid pace toward the pre-LAS pressure level after the valve has been closed, then the longwall system controller 301 determines that the PRS is supporting excessive roof weight due to an uncollapsed portion of the mining roof.

In some implementations, the longwall system controller 301 may be further configured to evaluate quantitative information from the pressure maps. For example, when the longwall system controller 301 determines that a portion of the mine roof has not collapsed as expected (using the method of FIG. 12A), the longwall system controller 301 may further evaluate the number of cutting passes that the shearer makes between mine roof collapse events using the method of FIG. 12B. While the shearer is operating (step 1211), the system detects pressure changes in adjacent PRSes indicative of mine roof collapse events and counts the number of cutting passes made by the shearer since the last detected collapse event (step 1213). If the number of cutting passes is less than a threshold (step 1215), the system continues to operate (step 1217). However, if the number of passes exceeds the predefined threshold, then the longwall system controller 301 applies mitigating action (step 1219).

The specific type of mitigation applied by the longwall system controller 301 may vary in different implementations and depending on the particular mining operation. For example, when the system detects that a certain number of cutting passes have been completed without a collapse event, the longwall system controller 301 may simply generate an alert that is output on the user interface 325 or transmitted to the surface computer 333. In other implementations, the system may be configured to adjust the cutting pattern of the longwall mining system. For example, operation may be adjusted such that, instead of positioning the PRSes in a linear arrangement, the PRSes are gradually moved into a more bowed or arced arrangement such that additional support is provided in the central portion of the longwall where the weight exerted on the PRSes is the greatest.

FIG. 13 illustrates another example of a quantitative monitoring technique applied using the pressure maps generated by the longwall system controller 301. During a mining operation, the movement of the shearer may be temporarily suspended to allow for mechanical system maintenance or breaks for operating personnel. However, the pressures exerted on the system by the mine roof can continue to change while the longwall mining system 200 sits idle. In the method of FIG. 13, while the shearer is idle (step 1301), the longwall system controller 301 continues to adjust the PRS actuators to support the mine roof. As pressures change and increase, some of the PRSes may approach or reach the yield condition where the check valve begins to release pressure from the piston cylinder. The longwall system controller 301 counts the number of PRSes that are at a defined percentage of the yield state (step 1303). As long as the number of PRSes that are at the defined percentage of yield remains below a threshold (step 1305), the system can remain idle (step 1307). However, when the number of PRSes at the defined percentage of yield exceeds the threshold, then the system applied mitigating action (step 1309).

As stated previously, the specific type of mitigation applied by the longwall system controller 301 may vary in different implementations and depending on the particular mining operation. In some implementations, different mitigation is applied as multiple thresholds are surpassed. For example, the system may generate a warning alert when a first number of PRSes reach the defined percentage of the yield state and, when the number of PRSes grows beyond a second threshold, the longwall system controller 301 may automatically initiate a system restart that will resume operation of the shearer.

Figure 14:
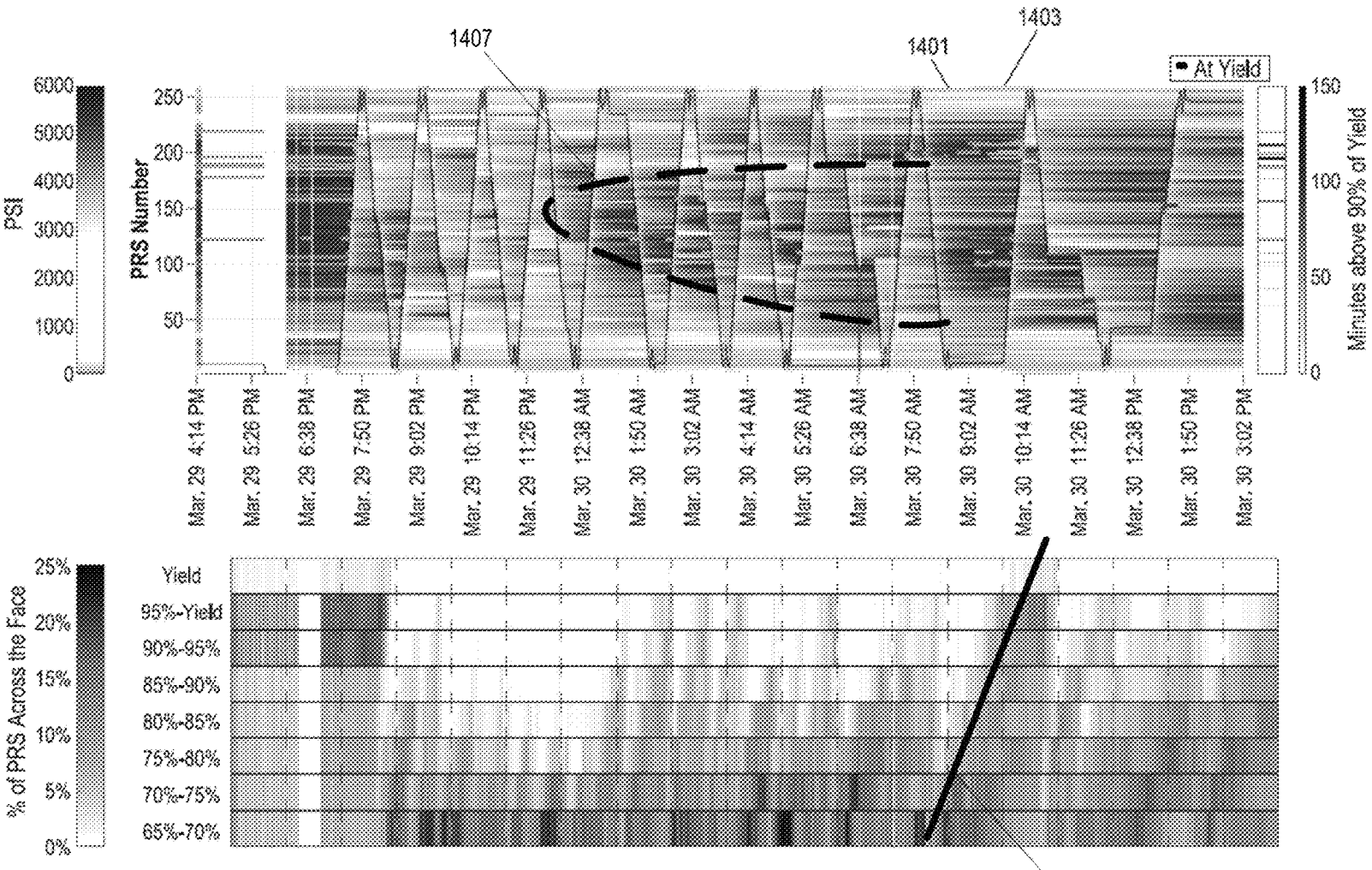
FIG. 14 is a graphical output displayed on the screen of the longwall mining system of FIG. 3 illustrating both a pressure map of pressures exerted on each powered roof support over a period of time and a time-based histogram illustrating the relative number of powered roof supports that are at or approaching yield conditions.

In some implementations, the system is configured to simply display the pressure map (e.g., as illustrated in FIG. 6). However, in other implementations, the system may be configured to provide additional graphical information indicative of the condition of the mine roof stability. For example, FIG. 14 shows a graphical display that is shown on the display 329 of the user interface 325 for a system that is configured to monitor the number of PRSes that are at or near the yield condition (e.g., using the method of FIG. 13). In this example, the pressure map in the upper portion of the display is similar to the pressure map discussed above in reference to FIG. 6. However, the lower portion of the display in FIG. 14 includes a time-line histogram indicating the number of PRSes that are at various percentages of pressure capacity over the same period of time using color-coding. At each time, the graphical display of FIG. 14 shows the number of PRSes that are 95-100% of the yield pressure threshold, the number of PRSes that are at 90-95% of the yield pressure threshold, and so on. Darker, more intense colors indicate a higher number of PRSes in each "histogram bin" at any given time.

In the particular example of FIG. 14, operation of the shearer is temporarily suspended at 1401. The lower portion of the graphical display of FIG. 14 shows that, after the movement of the shearer is stopped at 1401, the number of PRSes that are approaching the yield pressure threshold increases until the operation of the shearer is resumed at 1403.

The display format of FIG. 14 including both the pressure map and the time-line histogram provides addition visual and detectable information regarding changes in pressure and the condition of the mine roof. For example, when the operation of the shearer stops at 1401, the time-line histogram indicates a gradual increase in the number of PRSes that are at or near yield conditions (indicated by line 1405). In some implementations, the longwall system controller 301 is configured to detect and evaluate this change in the histogram data as discussed in further detail below. Furthermore, even though no "lines indicative of sudden decreases in pressure are visible in the example of FIG. 14, an area of darker coloration 1407 is present in the middle of the pressure map. This area is indicative of pressures increasing beyond expected levels across an increasing number of PRSes. IN some implementations, the longwall system controller 301 is configured to detect shapes and patterns in the pressure map data and to apply appropriate mitigation (e.g., generating an alert or modifying the operation of the longwall mining system).

Figure 15:
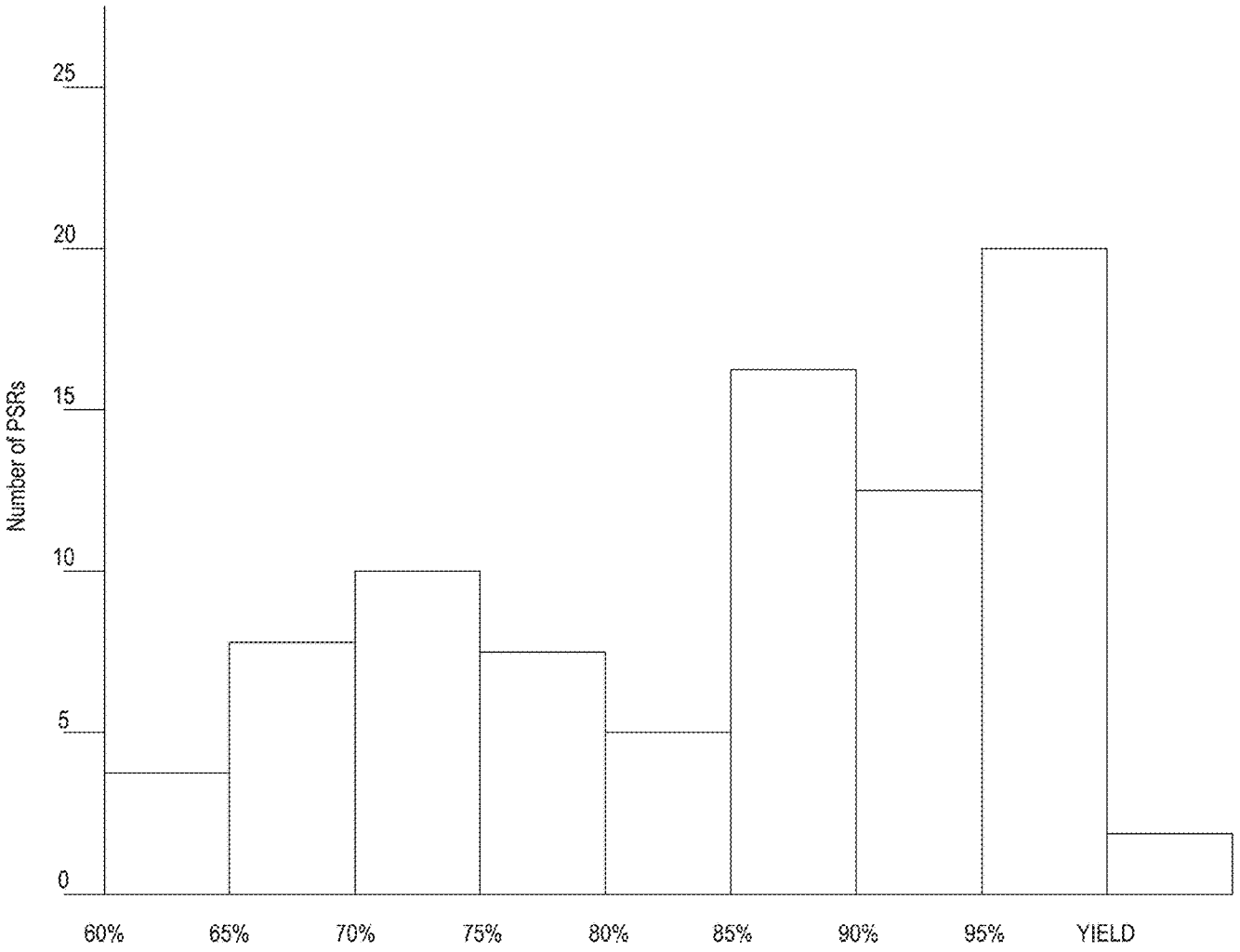
FIG. 15 is an instantaneous histogram illustrating the relative number of powered roof supports that are at or approaching yield conditions in the longwall mining system of FIG. 2.

In some implementations, the longwall system controller 301 is further configured to display such information in additional or alternative mechanisms. For example, instead of using the time-line histogram of FIG. 14 to illustrate the number of PRSes that are under excessive pressure, the longwall system controller 301 may be configured to display (either temporarily or as part of the main system display) an instantaneous pressure histogram such as illustrated in FIG. 15.

As discussed above in reference to FIG. 13, the system may be configured to monitor individual bins of the histogram and initiate mitigation when the number of PRSes that are at or above a certain pressure threshold (e.g., a percentage of yield pressure). However, as noted above, in other implementations, the control system may be configured to monitor changes in the time-line histogram of FIG. 14 and to predict the time at which a certain number of PRSes (or a percentage of the face) will be at or near yield conditions by tracking the rate of the number of PRSes in each bin of the histogram. Based on this prediction, the control system can generate an alert indicating when mine personnel must return to the mine to resume operation of the longwall mining system. This alert can be transmitted or displayed in the form of a "countdown."

Figure 16:
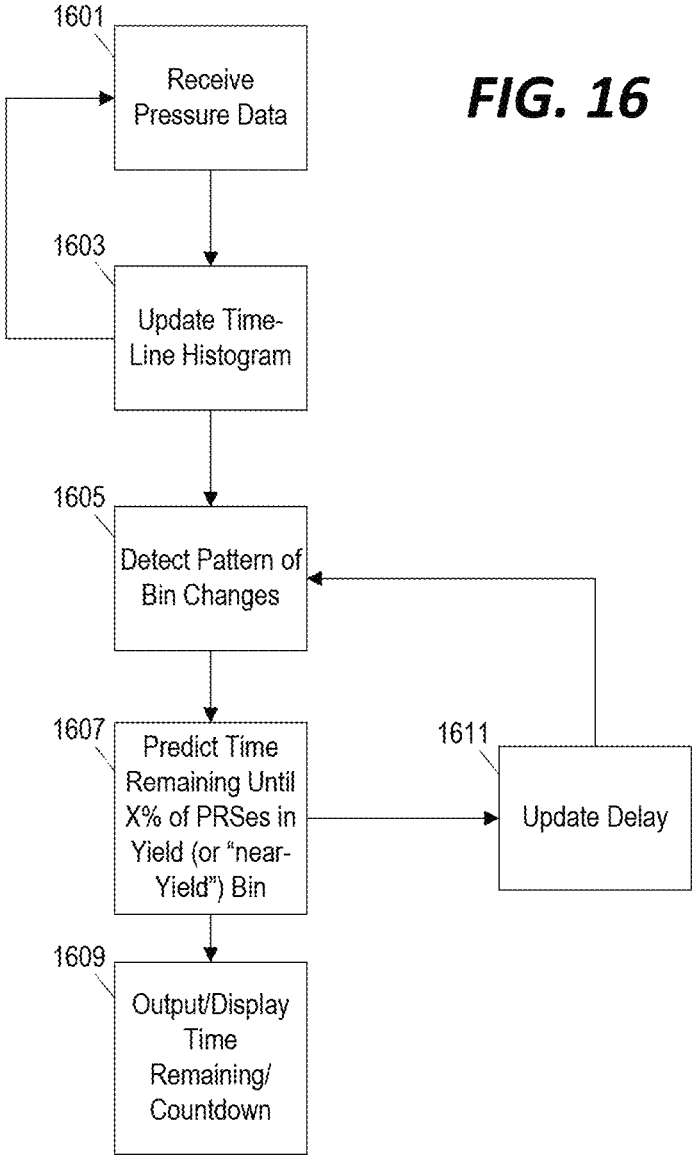
FIG. 16 is a flowchart of a method for predicting an amount of time remaining until a defined number of PRSes reach a yield (or near-yield) condition.

FIG. 16 illustrates on example of such a method. As the system receives pressure data from the PRSes (step 1601), the system continually updates the pressure map and the time-line histogram (step 1603). Based on this collected data, the system evaluates the time-line histogram to detect possible patterns in the bin changes (step 1605) (e.g., the line 1405 in FIG. 14). After a pattern indicative of changes in bin composition in the histogram is detected, the system processes the shape data to identify a formulaic best-fit for the shape. For example, the system may evaluate whether the changes in histogram data can be best represented as a linear function, as an exponential function, or as one of a plurality of other pre-programmed functions. Once a "best-fit" function is identified for the detected shape in the histogram data, the system is able to predict how the pattern will continue to evolve in the future and, based on that information, predicts an amount of time remaining until a defined number (or percentage) of the PRSes in the longwall mining system will be at or near the yield condition (step 1607). Based on this estimation, the system outputs and displays a countdown clock indicating the predicted amount of time remaining (step 1609).

Although, in this example, the system continually updates the histogram and pressure map data as new pressure data is received from the PRSes, the pattern detection and "best-fit" prediction modelling is only performed periodically to limit the computational load on the system. As such, after a prediction is made, the system will wait for a delay period (step 1611) before processing the data and updating the prediction. In some implementations, the duration of this delay period between estimations remains static. However, in other implementations, the delay period varies such that predictions are updated more frequently as the "countdown" (i.e., the predicted amount of time remaining until the defined number of PRSes approach the yield condition) approaches zero.

Figure 17:
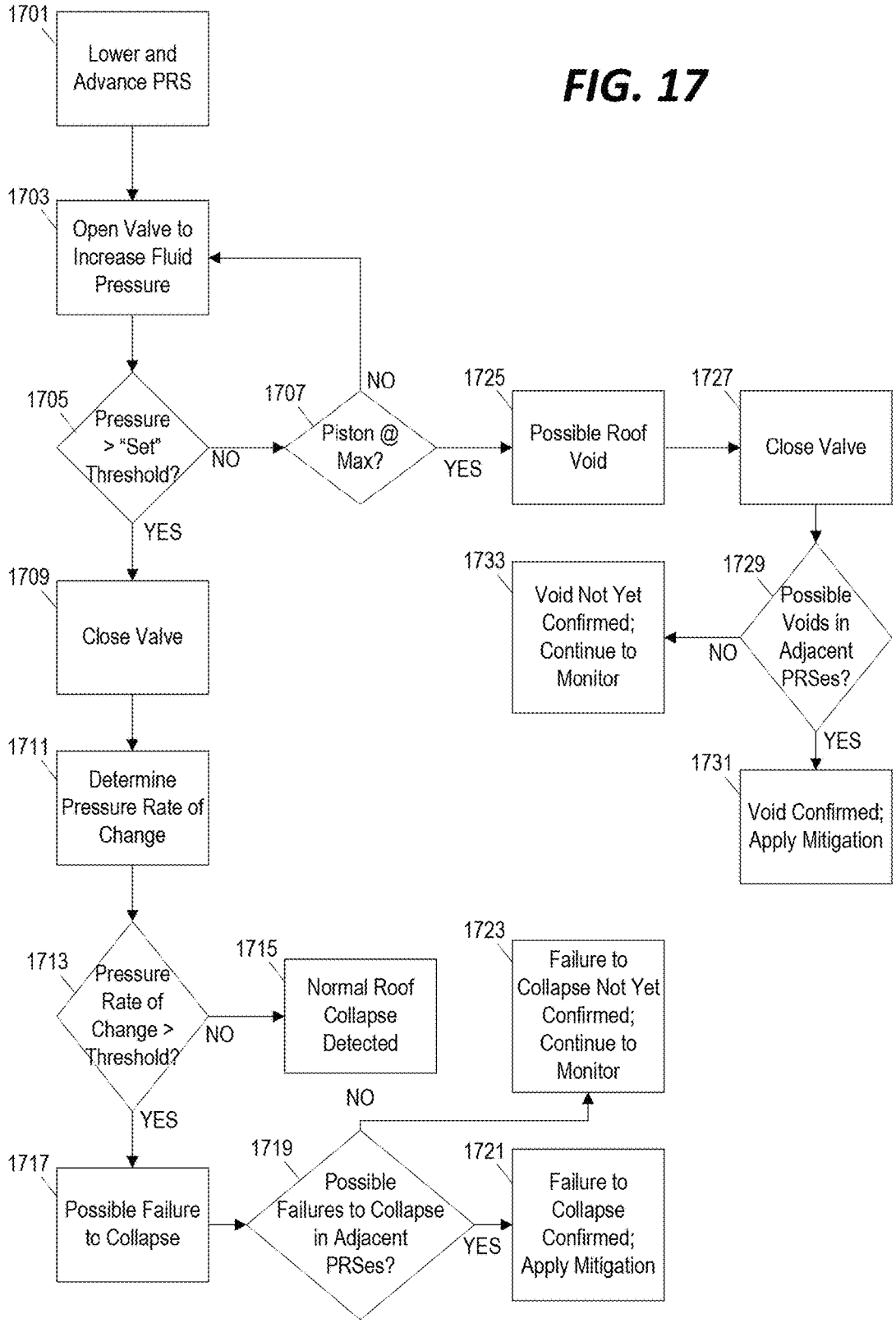
FIG. 17 is a flowchart of a method for monitoring and detecting abnormal mine roof conditions while adjusting the individual PRSes through the LAS cycle.

The examples above illustrate several potentially detectable mine roof conditions that can be identified using the systems and methods described above. However, in some implementations alternative or additional information regarding the condition of the mine roof can be determined based on the fluid pressure information from each PRS and/or using the generated pressure maps. For example, FIG. 17 illustrates a method for detecting mine roof instability including both premature roof crumbling and failures to collapse. After each PRS is lowered and advanced (step 1701), the valve of the piston cylinder is opened to the system line of the pump station to increase the fluid pressure in the piston (step 1703). This causes the canopy of the PRS to rise toward the roof of the mine.

Under normal operating conditions, the valve remains open until the fluid pressure within the cylinder reaches a threshold (step 1705). The valve is then closed (step 1709) and the system continues to monitor the fluid pressure to determine how the mine roof is affecting the fluid pressure within the cylinder as this rate of change may be indicative of a condition of the mine roof.

For example, a pump station may be configured to provide fluid pressure at 3500 PSI to the PRS through the system line and each PRS may be configured to yield (i.e., release of the check valve) at 7000 PSI. After an LAS cycle, the valve may be opened until the hydraulic system increases the internal pressure of the piston cylinder to 3500 PSI and then closes the valve. As the shearer continues to move across the mine face, the weight of the mine roof acting on the PRS canopy causes the fluid pressure within the gradually rise toward 6500 PSI before the next LAS cycle. If, following the next LAS cycle, the mine roof collapses as expected, the hydraulic system weight of the roof will again gradually increase from 3500 PSI toward 6500 PSI after the valve is closed. However, if the roof did not collapse as expected, the weight of the mine roof will quickly act upon the PRS after it is set at its new position and, after the valve is closed, the fluid pressure within the cylinder will quickly rise toward the internal pressure that had been detected before the LAS cycle.

Returning to the method of FIG. 17, after the valve is closed, the system determines a rate of change of the fluid pressure within the cylinder (step 1711) and, if that rate of change does not exceed a threshold (step 1713), then the system concludes that the mine roof has collapsed as intended after the completion of the LAS cycle (step 1715). However, if the rate of change exceeds the threshold, this could be indicative of a failure of the mine roof to collapse (step 1717). The system determines whether other possible failures to collapse have already been detected in adjacent PRSes (step 1719) and, if so, the system confirms that a mine roof has fail to collapse and may apply mitigation (step 1721). However, in some implementations, if possible failures to collapse have not already been detected in adjacent PRSes, the failure of the mine roof to collapse cannot yet be confirmed and the system continues to monitor the system before applying mitigation (step 1723).

In the method of FIG. 17, the monitored pressure data can also be indicative of a premature roof collapse. If the roof of the mine collapses or begins to crumble before the PRS is re-set at a new advanced position, then the canopy of the PRS might not be able to contact the mine roof at the new position or the mine roof will not be able to properly distribute its weight onto a particular PRS. In the example of FIG. 17, if the piston has raised the canopy of the PRS to a maximum position (step 1707) before the fluid pressure in the cylinder reaches the threshold (step 1705), then the system detects a possible "roof void" (step 1725) that may be indicative of a premature crumbling or collapse of the mine roof Alternatively, instead of determining that the piston has reached its maximum height, the system may be configured to detect a potential roof void condition based on whether a piston has failed to reach the threshold fluid pressure within an expected defined period of time.

When a possible roof void is detected (step 1725), the system closes the valve (step 1727) and determines whether any other possible voids have already been detected in adjacent PRSes (step 1729). If so, the roof void is confirmed (step 1731) and the system applies an appropriate mitigation. For example, the system may reduce the delay period between the passing of the shearer and the initiation of the LAS cycle (see, e.g., FIG. 5). Again, in this example, if other possible roof voids have not already been detected in adjacent PRSes, the system does not yet confirm the roof void condition and instead continues to monitor the roof condition (step 1733).

The longwall mining system 200 illustrated in FIG. 2 is just one example of a longwall mining system and may include additional or alternative components and/or configuration in other embodiments. Similarly, the block diagram of the control system illustrated in FIG. 3 is also just one example. In other implementations, individual components of the longwall mining system (e.g., the shearer, the PRS, the conveyor belt) may each have their own individual controllers. As such, the phrase "longwall system controller" as used above may refer to a single system controller as illustrated in the example of FIG. 3 or to multiple component-level controllers that together provide for the coordinated operation of the longwall mining system.

Thus, the invention provides, among other things, a system and method for monitoring stability of a roof of a longwall mine based on hydraulic pressures within the piston cylinders of each of a plurality of powered roof supports and using graphical pressure maps depicting the pressure exerted on each individual powered roof support and the relative position of a shearer over a period of time. Various features and advantages of the invention are set forth in the following claims.

What is claimed is:

1. A longwall mining system comprising:

a plurality of powered roof supports, each powered roof support including a controllable hydraulic piston configured to apply an adjustable support pressure on a mine roof;

a shearer configured to move across a mine face as the plurality of powered roof supports are arranged in a series along the mine face; and an electronic control unit configured to receive data from each powered roof support of the plurality of powered roof supports indicative of fluid pressure within each respective controllable hydraulic piston, and monitor a condition of the mine roof based on changes in the received data over a period of time, wherein the electronic control unit is configured to monitor the condition of the mine roof based on changes in the received data over a period of time by generating a graphical pressure map, the graphical pressure map including a plurality of parallel display lines each providing an indication of fluid pressure within a different one of the controllable hydraulic pistons of the plurality of powered roof supports over the period of time, and a shearer position line indicative of a position of the shearer relative to the plurality of powered roof supports over the period of time overlaid onto the plurality of parallel display lines.

2. The longwall mining system of claim 1, wherein the electronic control unit is further configured to monitor the condition of the mine roof by detecting temporally similar changes in the fluid pressure in multiple adjacent powered roof supports indicative of a mine roof collapse event.

3. The longwall mining system of claim 2, wherein the electronic control unit is further configured to monitor the condition of the mine roof by determining a linear best fit collapse line in the graphical pressure map based on the detected changes in the fluid pressure indicative of the mine roof collapse event.

4. The longwall mining system of claim 3, wherein the electronic control unit is further configured to monitor the condition of the mine roof by comparing a slope of the linear best fit collapse line to a sudden collapse slope threshold, and determining that a portion of the mine roof extending across more than one powered roof support has suddenly collapsed when the slope of the linear best fit collapse line exceeds the sudden collapse slope threshold, wherein the electronic control unit is further configured to transmit an alert to a remotely located computer in response to determining that the portion of the mine roof has suddenly collapsed.

5. The longwall mining system of claim 3, wherein the electronic control unit is further configured to monitor the condition of the mine roof by comparing a slope of the linear best fit collapse line to a slope of at least a portion of the shearer position line, and wherein the electronic control unit is further configured to adjust a speed of the linear movement of the shearer across the mine face based on a difference between the slope of the linear best fit collapse line and the slope of the shearer position line.

6. The longwall mining system of claim 3, wherein the electronic control unit is further configured to monitor the condition of the mine roof by calculating an average temporal spacing between the linear best fit collapse line and at least a portion of the shearer position line, and wherein the electronic control unit is further configured to lower, advance, and set each powered roof support after a delay in response to the shearer moving past the individual powered roof support along the mine face, and adjust a duration of the delay based on the average temporal spacing between the linear best fit collapse line and the shearer position line.

7. The longwall mining system of claim 1, further comprising a user interface including a display, and wherein the electronic control unit is configured to output the graphical pressure map to the display of the user interface.

8. The longwall mining system of claim 1, wherein the electronic control unit is further configured to transmit the fluid pressure data to a remotely located computer system, and wherein the remotely located computer system is configured to receive fluid pressure data from a plurality of longwall mining systems and to develop optimized mining procedures based on the received fluid pressure data.

9. The longwall mining system of claim 1, wherein the electronic control unit is further configured to adjust operation of the longwall mining system based on the monitored condition of the mine roof.

10. The longwall mining system of claim 1, wherein the electronic control unit is further configured to determine a value indicative of the adjustable support pressure applied to the mine roof by each individual powered roof support based on the fluid pressure within each respective controllable hydraulic piston.

11. A method of monitoring a condition of a mine roof using a longwall mining system, the method comprising:

operating a plurality of powered roof supports arranged in a series along a mine face to apply an adjustable support pressure on the mine roof;

operating a shearer to move across the mine face cutting into the mine face;

receiving data from each powered roof support of the plurality of powered roof supports indicative of the adjustable support pressure applied by each individual powered roof support to the mine roof;

generating a graphical pressure map based on the data received from each powered roof support, the graphical pressure map including a plurality of parallel display lines each providing an indication of the adjustable support pressure applied to the mine roof by a different one of the powered roof supports over a period of time, and a shearer position line indicative of a position of the shearer relative to the plurality of powered roof supports over the period of time overlaid onto the plurality of parallel display lines; and monitoring a condition of the mine roof based on changes in the adjustable support pressure shown in the graphical pressure map.

12. The method of claim 11, wherein the data received from each of the powered roof supports includes a measure of pressure applied by an actuator of the powered roof support.

13. The method of claim 12, wherein operating a plurality of powered roof supports includes controllably adjusting a fluid pressure within a cylinder of a hydraulic piston of at least one of the powered roof supports, and wherein the measure of pressure applied by the actuator of the powered roof support includes a measure of the fluid pressure within the cylinder of the hydraulic piston of the at least one powered roof support.

14. The method of claim 11, further comprising displaying the graphical pressure map on a user interface.

15. The method of claim 11, further comprising:

transmitting the graphical pressure map to a remotely located computer system, and analyzing the graphical pressure map and a plurality of additional graphical pressure maps to develop optimized mining procedures based on the adjustable support pressure applied to the mine roof by the plurality of powered roof supports.

16. The method of claim 11, wherein monitoring the condition of the mine roof includes detecting temporally similar changes in the adjustable support pressure applied to the roof by multiple adjacent powered roof supports indicative of a mine roof collapse event.

17. The method of claim 11, further comprising adjusting operation of the longwall mining system based on the monitored condition of the mine roof.

18. A control system for a longwall mining system, the control system including a processor and a memory storing instructions that, when executed by the processor, cause the control system to:

operate a plurality of powered roof supports arranged in a series along a mine face to apply an adjustable support pressure on the mine roof;

operate a shearer to move across the mine face cutting into the mine face;

receive data from each powered roof support of the plurality of powered roof supports indicative of the adjustable support pressure applied by each individual powered roof support to the mine roof;

generate a graphical pressure map based on the data received from each powered roof support, the graphical pressure map including a plurality of parallel display lines each providing an indication of the adjustable support pressure applied to the mine roof by a different one of the powered roof supports over a period of time, and a shearer position line indicative of a position of the shearer relative to the plurality of powered roof supports over the period of time overlaid onto the plurality of parallel display lines; and monitor a condition of the mine roof based on changes in the adjustable support pressure shown in the graphical pressure map.

19. The control system of claim 18, wherein the data received from each of the powered roof supports includes a measure of pressure applied by an actuator of the powered roof support.

20. The control system of claim 19, wherein the instructions, when executed by the processor, cause the control system to operate the plurality of powered roof supports by controllably adjusting a fluid pressure within a cylinder of a hydraulic piston of at least one of the powered roof supports, and wherein the measure of pressure applied by the actuator of the powered roof support includes a measure of the fluid pressure within the cylinder of the hydraulic piston of the at least one powered roof support.

21. The control system of claim 18, wherein the instructions, when executed by the processor, further cause the control system to display the graphical pressure map on a user interface.

22. The control system of claim 18, wherein the instructions, when executed by the processor, further cause the control system to adjust operation of the longwall mining system based on the monitored condition of the mine roof.

23. The control system of claim 18, wherein the instructions, when executed by the processor, cause the control system to monitor the condition of the mine roof by detecting temporally similar changes in the adjustable support pressure applied to the mine roof in multiple adjacent powered roof supports indicative of a mine roof collapse event.

* * * * *